US006814638B2

(12) United States Patent
Wada et al.

(10) Patent No.: US 6,814,638 B2
(45) Date of Patent: Nov. 9, 2004

(54) AIRDROP TYPE BUOY APPARATUS

(75) Inventors: Shigeru Wada, Kanagawa (JP); Saburo Ohashi, Kanagawa (JP); Shigeki Akamatsu, Kanagawa (JP)

(73) Assignee: Japan Aircraft Manufacturing Co., Ltd., Kanagawa (JP)

( * ) Notice: Subject to any disclaimer, the term of this patent is extended or adjusted under 35 U.S.C. 154(b) by 0 days.

(21) Appl. No.: 10/390,375

(22) Filed: Mar. 17, 2003

(65) Prior Publication Data

US 2004/0185727 A1 Sep. 23, 2004

(51) Int. Cl.[7] ..... B63B 22/16
(52) U.S. Cl. ..... 441/6
(58) Field of Search ..... 441/1, 6, 11–20

(56) References Cited

U.S. PATENT DOCUMENTS 3,328,750 A * 6/1967 Gimber et al. ..... 367/3
4,298,963 A * 11/1981 Dejob et al. ..... 367/4
4,673,363 A * 6/1987 Hudson et al. ..... 441/1

FOREIGN PATENT DOCUMENTS

| | | |
|---|---|---|
| JP | 52-023897 A | 2/1977 |
| JP | 57-135497 | 8/1982 |
| JP | 5-075097 | 10/1993 |
| JP | 10-615433 | 5/2000 |

* cited by examiner

*Primary Examiner*—Ed Swinehart
(74) *Attorney, Agent, or Firm*—Lawrence E. Laubscher, Jr.

(57) ABSTRACT

An airdrop type buoy apparatus, which is dropped by a flight vehicle, such as aircraft, that is flying in the air, to a water surface of sea or lake to be floated as a marker, a hydrographic conditions measuring device or the like, for flexibly coping with a shock at the time of landing on the water to absorb the landing shock on a balloon and also suppressing the rise of an inner pressure of the balloon so that the balloon is hardly to burst.

16 Claims, 6 Drawing Sheets

AIRDROP TYPE BUOY APPARATUS

BACKGROUND OF THE INVENTION

1. Field of the Invention

The present invention relates to an airdrop type buoy apparatus, which is dropped to a war surface of sea or lake by a flight vehicle, such as aircraft that is flying in the air, to be floated as a marker, a hydrographic conditions measuring device or the like, and particularly, relates to an airdrop type buoy apparatus for flexibly coping with a shock at the time of landing on the water to absorb the landing shock on a balloon and also suppressing the rise of an inner pressure of the balloon so that the balloon is hardly to burst.

2. Description of the Related Art

As disclosed in Japanese Unexamined Patent Publication No. 2000-128087, such a conventional type airdrop type buoy apparatus that is dropped by a flight vehicle flying in the air to be floated on the water of sea or lake, comprises: a balloon which lets air therein at an opening thereof while falling, to expand, decreases a falling speed thereof to a speed at which a burst due to an aerodynamic load and a shock at the time of landing on the water does not occur, and then lands on the water to thereby function as a marker, and a container which is connected to the opening of the balloon to house the balloon therein, falls to introduce air to the opening of the balloon and also to function as a plumb bob; arm drawing means for drawing the balloon out of the container.

However, in such a conventional airdrop type buoy apparatus, the container functioning as the plumb bob is connected to the opening of the balloon, and thus the balloon that lets air therein via the opening to ed during falling in the air, and the container (plumb bob) are directly connected to each other to be integrated. Therefore, for example, when the container lands on the water of sea, a shock at the time of landing acting on the container also acts an the balloon directly. Further, when such a landing shock acts on the container, the balloon is dragged into the water due to inertia of the container. As a result a lower part of the balloon receives a water pressure to be deformed so that an inner pressure of the balloon rises abruptly.

Thus, according to the conventional airdrop type buoy apparatus, since the landing shock directly acts on the balloon and the inner pressure of the balloon rises abruptly when landing, there is a possibility that the balloon burst when landing. Then, if burst, the balloon cannot function as the marker after landing. In order to avoid such a situation, there is a necessity to form the balloon in solid. However, if the thickness of film material or the structural intensity of balloon is increased, there is a possibility of increase in weight and size, and further the rise of manufacturing cost.

SUMMARY OF THE INVENTION

The present invention has been accomplished in view of the problems as described above and has an object to provide an airdrop type buoy apparatus for flexibly coping with a shock at the time of landing on the water to absorb the landing shock on a balloon and also for suppressing the rise of an inner pressure of the balloon so that the balloon is hardly to burst.

In order to achieve the above object, an airdrop type buoy apparatus according to one aspect of the present invention, which is dropped by a flight vehicle flying in the air, and during failing, decreases a falling speed thereof to a predetermined speed while expanding, and then lands on the water to be floated, comprises: a balloon provided, at a lower end opening thereof, with an annular member for introducing air into the balloon when falling, for letting air therein via the annular member to expand to hold a three-dimensional shape after landing; a suspension rope connected to the annular member of the balloon at one end portion thereof and having flexibility to extend by a predetermined length; and a plumb bob connected to the other end portion of the suspension rope to serve as a plummet at the time of falling and landing of the balloon.

With the above constitution, the balloon and the plumb bob are connected to each other via the suspension rope having the flexibility to extend by the predetermined length. Thus, when the plumb bob lands on the water, since the suspension rope loosens, it becomes possible to flexibly cope with a shock at the time of landing to absorb the landing shock on the balloon, and also to suppress the rise of an inner pressure of the balloon so that the balloon is hardly to burst. Consequently, it is unnecessary to form the balloon in solid differently from the conventional technique, thereby enabling to reduce the weight and size, and also the manufacturing cost of the balloon.

Further, an airdrop type buoy apparatus according to another aspect of the present invention, which is dropped by a flight vehicle flying in the air, and during failing, decreases a falling speed thereof to a predetermined speed while expanding, and then lands on the water to be floated, comprises: a balloon provided, at a lower end opening hereof, with an annular member for introducing air into the balloon when falling, for letting air therein via the annular member to expand to hold a three-dimensional shape or landing; a suspension rope connected to the annular member of the balloon at one end portion thereof and having flexibility to extend by a predetermined length; a plumb bob connected to the other end portion of the suspension rope to serve as a plummet at the time of falling and landing of the balloon; and a container housing therein a combination of the balloon, suspension rope and plumb bob, and accessories thereof, to be delivered for dropping.

With such a constitution, the combination of the balloon, suspension rope and plumb bob, and the accessories thereof are housed in the container, to be delivered for dropping. Thus, it becomes possible that the airdrop type buoy apparatus is loaded on the flight vehicle, such as aircraft to be delivered, and dropped to a required water surface as a marker, a hydrographic conditions measuring device or the like.

Other objects, characteristics and advantages of the present invention will become apparent from the following description of embodiments, in conjunction with the appended drawings.

DETAILED DESCRIPTION OF THE INVENTION

Figure 1:
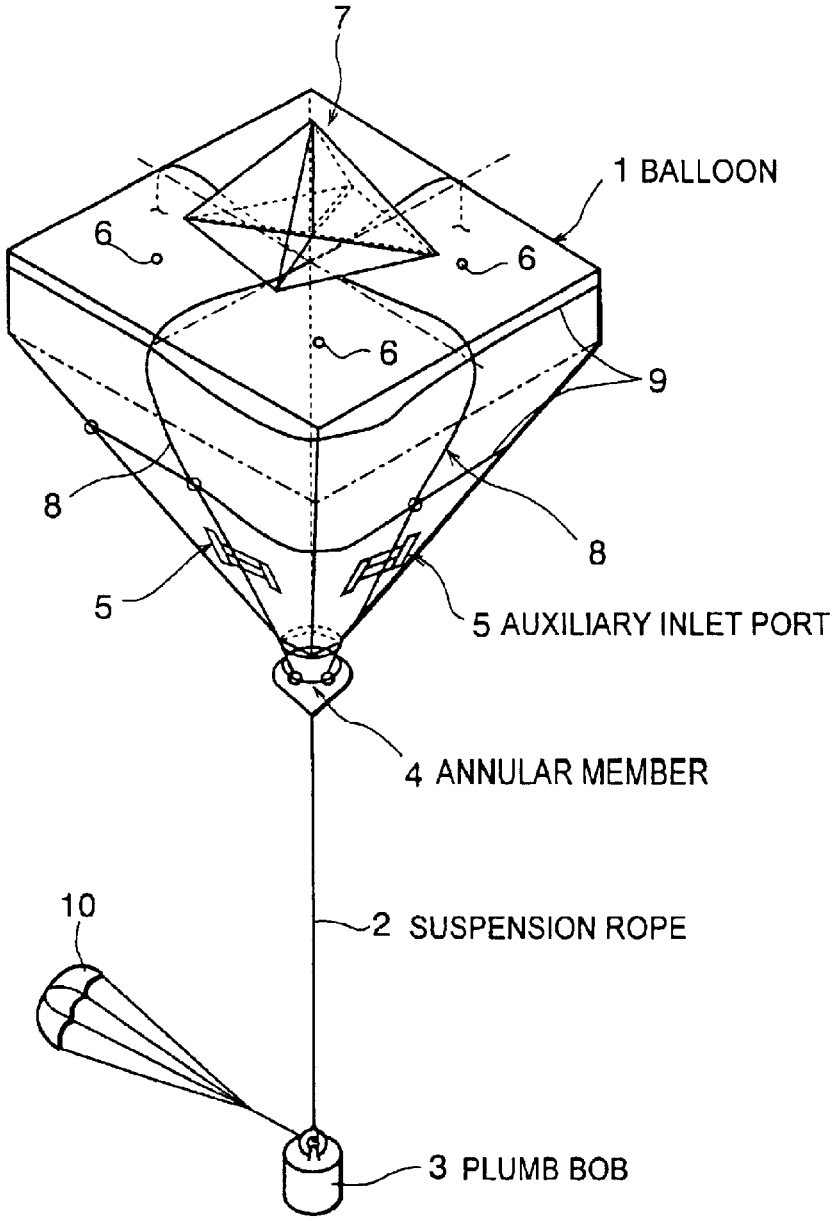
FIG. 1 is a perspective view showing an embodiment of an airdrop type buoy apparatus according to the present invention.

FIG. 1 is a perspective view showing an embodiment of an airdrop type buoy apparatus according to the present invention. The airdrop type buoy apparatus is to be dropped to the water surface of sea or lake by a fight vehicle, such as aircraft, that is flying in the air, to be floated as a marker, a hydrographic conditions measuring device or the like. The airdrop type buoy apparatus is dropped, and during falling, decrease a falling speed thereof to a predetermined speed while expanding, to land on the water. As shown in FIG. 1, the airdrop type buoy apparatus comprises a balloon 1 (expanded state is shown), a suspension rope 2 and a plumb bob 3.

The balloon 1 lets air therein by a ram pressure at the time of falling, to expand, and holds a three-dimensional shape after landing on the water. The balloon 1 is formed in a bag shape of inverted pyramid with a square upper face using a biodegradable film material (biodegradable plastic), for example. Thus, since the balloon 1 is formed in the bag shape using the biodegradable film material, as described below, the loon 1 that has deceased a buoyant force thereof to be scuttled after a predetermined period of time from landing, is naturally decomposed by microorganism in the water, thereby enabling to suppress the water pollution in practice waters and the like.

The balloon 1 of inverted pyramid shape includes, at a lower end apex portion thereof; an opening portion for letting air in the balloon 1, and an annular member 4 of cylinder shape, for example, for introducing the air into the balloon when falling, is mounted to the lower end opening portion. Accordingly, me annular member 4 defines an inlet for letting air in the balloon 1. Note, the material of the annular member 4 is not limited to a metal, but may be plastics or the like.

Figure 7:
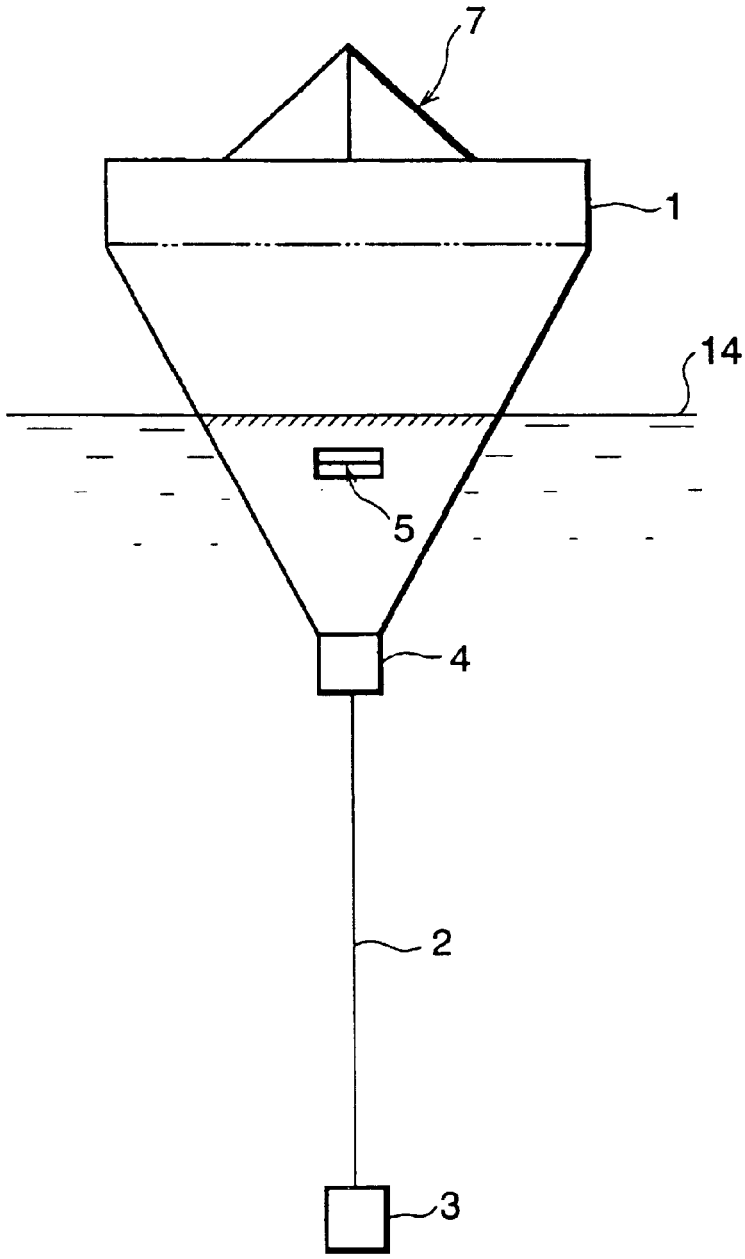
FIG. 7 is a view for explaining a state where the airdrop type buoy apparatus is stabled after landing, to be used for various paces

Further, auxiliary inlet ports 5 are formed on side face portions of the balloon 1. Each auxiliary inlet port 5 is an auxiliary opening for letting air in the balloon 1 when the air enters the balloon 1 via the annular member 4, and is formed as a slit in which a cut is made on a middle portion in a lengthwise direction of the side face portion. Further, each auxiliary inlet port 5 is formed on a position that is to be scuttled when the expanded balloon 1 lands on the water, as shown in FIG. 7 to be described later. Accordingly, it becomes possible to assist the balloon 1 to let the air therein so that the balloon 1 expands rapidly, and also to assist the landed balloon 1 to be floated on the water.

Further, one or more fin hoes 6 are formed on the upper face portion of the balloon 1. Each fine hole 6 is formed so ta the balloon 1 expanded by letting air therein decreases the buoyant force thereof to be scuttled after the predetermined period of time at the landed position. For example, four fine holes a are formed on the upper face portion of the balloon 1. Note, the number and diameter of the fine hole 6 may be appropriately determined according to the predetermined period of time until the balloon 1 is scuttled.

The annular member 4 of the balloon 1 is connected with the suspension rope 2. The suspension rope 2 is for connecting between the balloon 1 and the plumb bob 3 to be described later. The suspension rope 2 which consists of a rope having flexibility so as to be freely bent or to be wound up, is connected to the annular member 4 of the balloon 1 at one end portion thereof, and extends downward by a predetermined length. The flexibility of the suspension rope 2 is for the purpose that, when the plumb bob 3 to be described later lands on the water, the suspension rope 2 loosens to flexibly cope with the shock at the time of landing, to absorb the landing shock on the balloon 1, and also to suppress the rise of an inner pressure of the balloon 1 so that the balloon is hardly to burst.

The other end portion of the suspension rope 2 is connected with the plumb bob 3. The plumb bob 3 serves as a plummet at the time of falling and landing of ft balloon 1, and may be made up by a metal, for example, so as to have appropriate weight, taking into consideration of the falling sped of the balloon 1 in the air and of the buoyant force acting on the balloon 1 in the water.

On the upper face portion of the balloon 1, there is disposed a buoyant recognition member 7, as an example of a function member for being floated on the water to achieve a predetermined function after the expanded balloon 1 lands on the water. The buoyant recognition member 7 is to be recognized as a marker indicating a predetermined point on the water after the balloon 1 lands on the water, and consists of, for example, a reflecting body or a luminance body, or an electric wave reflecting body or an electric wave emitter, of appropriate shape for visual recognition. The buoyant recognition member 7 is secured on the upper face portion of the balloon 1 in a state where, for example, four securing cables 8 each of which is connected at one end portion thereof to the annular member 4 on the lower end portion of the balloon 1, are tied to the buoyant recognition member 7 at the other end portions. Thus, the buoyant recognition member 7 can be reliably secured on the upper face portion of the balloon 1.

Then, the four securing cables 8 are connected to each other via guide cables 9, which are wound on me outer periphery of the balloon 1 within a range of the height in the lengthwise direction of the balloon 1. The guide cables 9 are wound around the balloon 1, respectively, at the upper end portion and middle portion in the lengthwise direction of the balloon 1, to be connected to the securing cables 8. Thus, the four securing cables 8 are prevented from removing from the balloon 1 during balloon 1 falls.

Figure 2:
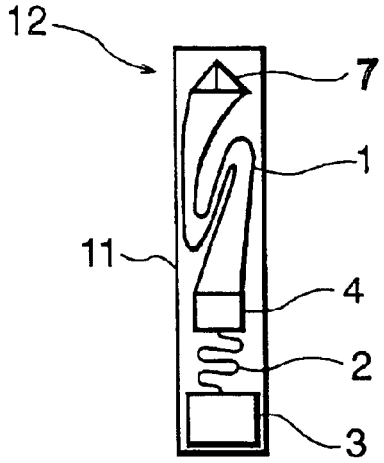
FIG. 2 is a sectional view for explaining a state where a combination of a balloon, a suspension rope and a plumb bob, and accessories thereof according to the present invention are housed in a container.
Figure 3:
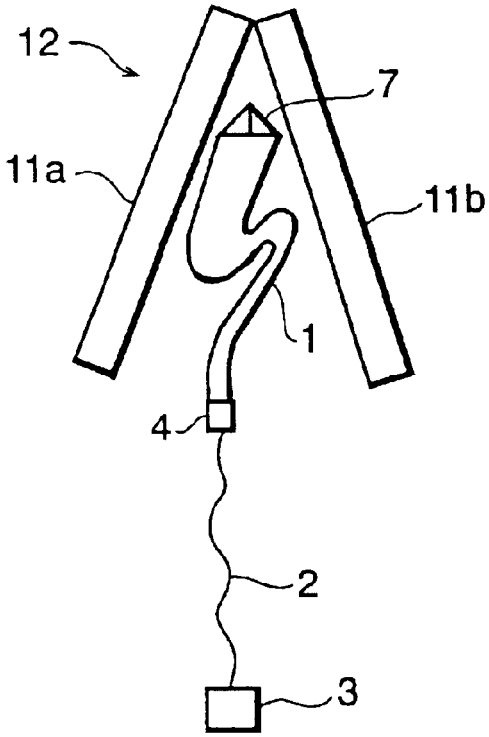
FIG. 3 is a view for explaining a slate where the container is opened after the airdrop type buoy apparatus is dropped by an aircraft.

Further, the plumb bob 3 is added with a parachute 10 for absorbing a shock due to a stretch of the suspension rope 2 when me balloon 1 falls. A size of the parachute 10 needs not to be so relatively large, since the parachute 10 is for only absorbing the shock due to the stretch of the suspension rope 2 when the plumb bob 3 and the balloon start to fall. Thus, it is possible to absorb by the parachute 10 the shock due to stretch of the suspension rope 2 when the plumb bob 3 and the balloon 1 start to fall Then, as shown in FIG. 2, a combination of the balloon 1, the suspension rope 2, and the plumb bob 3, and their accessories is housed in an appropriate container, such as a cylindrical container 11 to be delivered, and is dropped as an airdrop type buoy apparatus 12. The combination of the balloon 1, the suspension rope 2, and the plumb bob 3, and their accessories is loaded on an aircraft in a state of being housed in the cylindrical container 11. When the airdrop type buoy apparatus 12 is dropped by the aircraft, as shown in FIG. 3, the cylindrical container 11 is just divided into two portions 11*a* and 11*b* along a longitudinal direction, for example, so that the balloon 1, the suspension rope 2 and the plumb bob 3 that are connected to each other, are thrown out Next, the use of the airdrop type buoy apparatus constituted as the above will be described referring to FIGS. 4 to 7. Firstly, in the airdrop type buoy apparatus in the state of being stocked or delivered before being dropped, as shown in FIG. 2, the balloon 1 that is folded in a fiat state, the suspension rope 2 and the plumb bob 3 are connected to each other, to be housed in the cylindrical container 11 of elongated shape, or example. Then, the balloon 1, the suspension rope 2 and the plumb bob 3 that are housed in the cylindrical container 11, are loaded on an aircraft 13 as the airdrop type buoy apparatus 12 (refer to FIG. 4).

Figure 4:
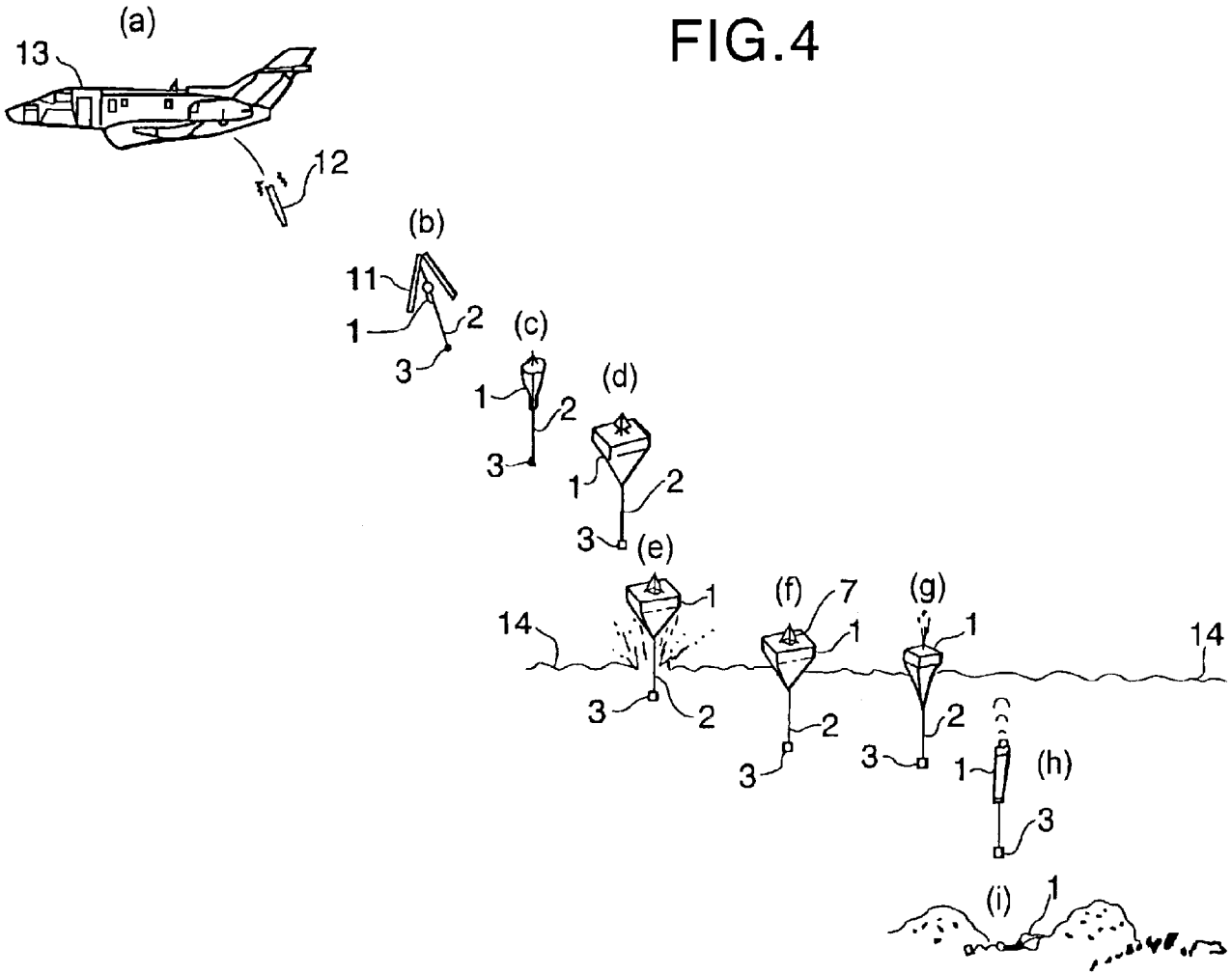
FIG. 4 is view for explaining a state where the airdrop type buoy apparatus is used.

Next, the aircraft 13 loaded with me airdrop type buoy apparatus 12 flies in the sky over predetermined practice waters, and ten, as shown in (a) of FIG. 4, drops the airdrop type buoy apparatus 12 at a point of salvage or search practice. The dropped airdrop type buoy apparatus 12 falls freely as it is, and then at a predetermined altitude or speed, as shown in (b) of FIG. 4 and FIG. 3, the cylindrical container 11 is just divided into the two portions 11*a* and 11*b* along the longitudinal direction, for example, to throw out the balloon 1, the suspension rope 2 and the plumb bob 3 that are connected to each other. At his time, in the airdrop type buoy apparatus 12, due to inertia and gravity, the plumb bob 3 between at the lowest position, the suspension rope 2 follows the plumb bob 3, and further the balloon 1 follows the suspension rope 2, to start to fall.

Figure 5:
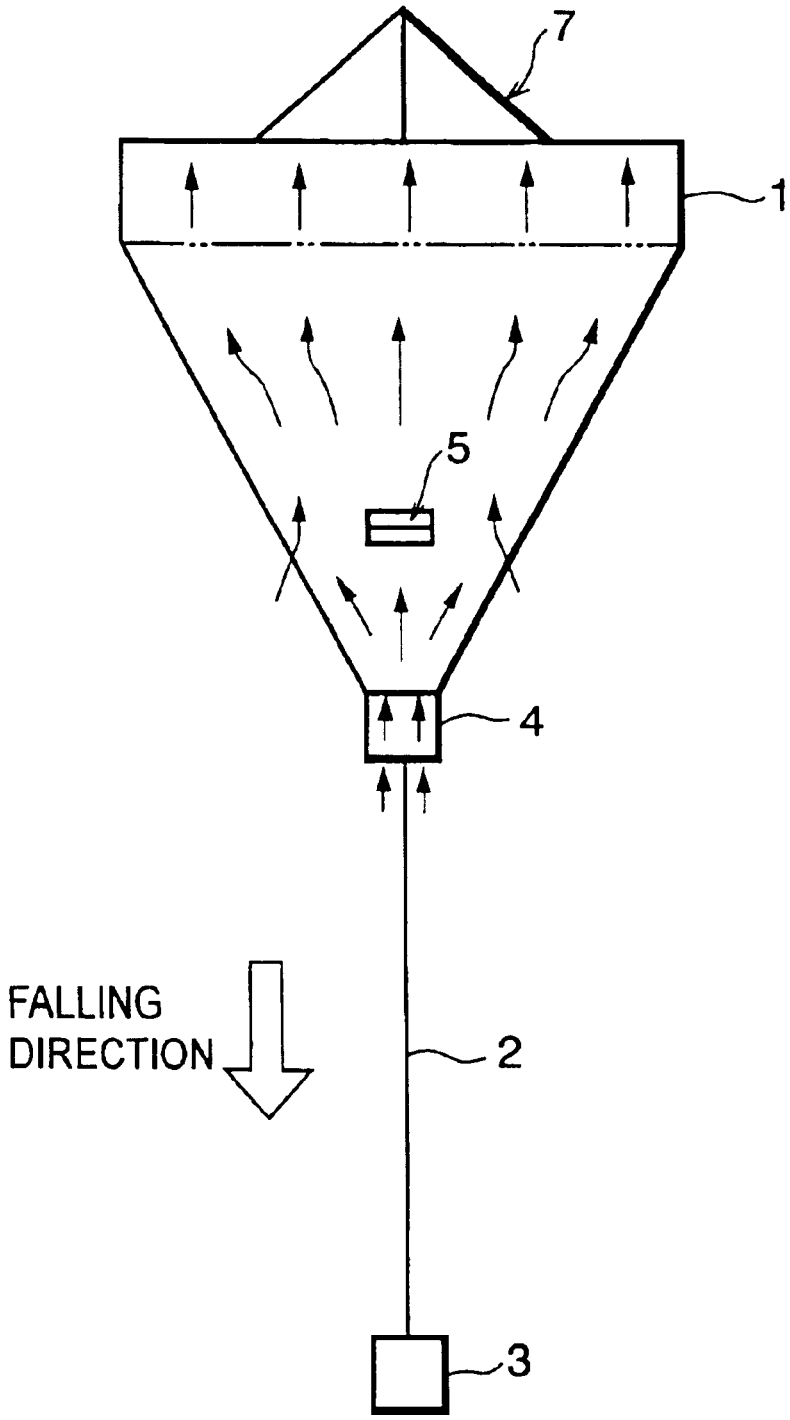
FIG. 5 is a sectional view for explaining a state where the balloon lets air therein to expand during the airdrop type buoy apparatus is falling in the air.
Figure 6:
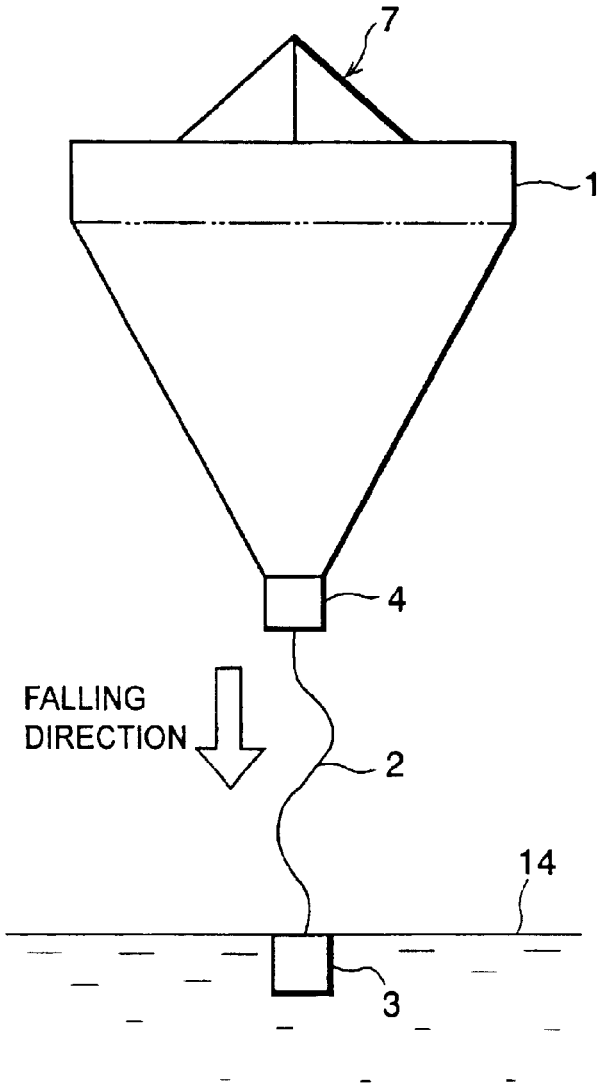
FIG. 6 is a view for explaining a state where the airdrop type buoy apparatus falls to land on the water.

Then, as shown in (c) of FIG. 4, the suspension rope 2 is stretched by the weight of the plumb bob 3 so that the balloon 1 arts to fall. At this time, the parachute 10 shown in FIG. 1 is opened to absorb the shock due to the stretch of the suspension rope 2. Then, in this state, the entire airdrop type buoy apparatus 12 falls. At the falling time, since the annular member 4 and the auxiliary inlet ports 5 face the air stream direction as shown in FIG. 5, the balloon 1 lets the air therein via the annular member 4 and the auxiliary inlet ports 5 due to the ram pressure at the time of falling, to expand into the three-dimensional shape. The auxiliary inlet ports 5 assist the airflow into the balloon 1 therethrough to accelerate the expansion of the balloon 1, Thus, a shown in (d) of FIG. 4, the balloon 1 that has been fulfilled with the air to end, decreases the falling speed to the predetermined speed due to an air resistance thereto with the plumb bob 3 underside thereof, and falls at a steady state speed. Then, when airdrop type buoy apparatus 12 fags to the water surface 14, firstly the plumb bob 3 land on the water as shown in (e) of FIG. 4. At this time, the plumb bob 3 stops temporarily the falling due to a resistance from the war surface 14, and the suspension rope 2 loosens as shown in FIG. 6, since the suspension rope 2 consists of the material having the flexibility to extend by a predetermined length.

Since the suspension rope 2 loosens and is not subjected to a tensile force, the falling speed of the balloon 1 is changed to a falling speed determined by a balance of the weight of the balloon 1 and the air resistance, and the balloon 1 falls in a steady state speed lower than the steady state speed up to then to land on the water surface 14. The suspension rope 2 loosens, and therefore, it is possible to flexibly cope with the shock at the time of landing to absorb the landing shock on the balloon 1, and also to suppress the rise of inner pressure so that the balloon 1 is hardly to burst.

After the balloon 1 lands on the water surface, since the water enters the balloon 1 via the annular member 4 and the air within the balloon 1 flows to the outside via the auxiliary inlet ports 5, the balloon 1 gradually sinks due to the weight thereof and the weight of the plumb bob 3. However, as shown in FIG. 7, the balloon 1 becomes watertight at a time when the auxiliary inlet pot 5 sink under the water surface 14, to be floated on the water surface 14. Then, as shown in (f) FIG. 4, the balloon 1 holds the three-dimensional shape on the water surface 14 to become a marker, and is floated appropriately. In this sate, as shown in FIG. 7, the suspension rope 2 is stretched due to the weight of the plumb bob 3 to be subjected to the tensile force, thereby dragging the balloon 1 downwards to hold the balloon 1 stable.

Thus, in the state where the balloon 1 is floated on the water surface 14 as the marker, a launch and the like or an aircraft and the like in the practice waters performs the salvage or search practice. At this time, by means of the buoyant recognition member 7 disposed on the upper face portion of the balloon 1, the presence of the airdrop type buoy apparatus is recognized by the launch and the like or the aircraft and the like. Therefore, it becomes possible to effectively perform the salvage by the launch and the like or the search practice by the aircraft and the like.

During such practices, the air within the balloon 1 flows out little by little in stationary via the plurality of fine holes 6. There, as shown in (g) and (h) of FIG. 4, the balloon 1 decreases buoyancy hereof after the lapse of a predetermined period of time (for example, about 12 hours) after landing on the water surface 14, to be scuttled by the weight of the plumb bob 3.

Then, as shown in (i) of FIG. 4, the biodegradable film material of the balloon 1 that sunk to the bottom from the water surface 14, is naturally decomposed by microorganism in the water, with the time lapse. Thereby, it becomes possible to limit the water pollution in practice waters and the like.

Note, in the above description, the constitution has been such that the balloon 1 that is folded in the flat so, the suspension rope 2 and the plumb bob 3 are connected to each other, and am housed in the cylindrical container 11, to be loaded on the aircraft 13 as the airdrop type buoy apparatus 12 for dropping. However, the present invention is not limited thereto, and may be constituted such that the balloon 1, the suspension rope 2 and the plumb bob 3 that are connected to each other, are hauled up by a helicopter to be delivered to the practice waters for dropping.

Moreover, in the above description, the constitution has been such that the buoyant recombination member 7 is disposed on the upper face portion of the balloon 1 as the function member. However, the present invention is not limited thereto, and may be constituted such that is disposed a hydrographic conditions measuring member provided with a hydrographic conditions sensor that measures hydrographic conditions and a transmitter that transmits information measured by the hydrographic conditions sensor via radio waves, for measuring hydrographic conditions at a predetermined point on the water. In this case, the airdrop type buoy apparatus serves as a hydrographic conditions measuring apparatus that is dropped to be float. Furthermore, any other arbitrary function member other than the buoyant recognition member 7 or the hydrographic conditions measuring member may be disposed on the airdrop type buoy apparatus.

What is claimed is:

1. An airdrop type buoy apparatus, which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

a suspension rope connected to said annular member of the balloon at one end portion thereof so as to extend by a predetermined length, said suspension rope having flexibility; and a buoyant recognition member disposed on an upper surface portion of said balloon, for being floated on the water to act as a marker indicating a predetermined point on the water after the expanded balloon lands on the water.

2. An airdrop type buoy apparatus according to claim 1, wherein said balloon is formed in a bag shape using a biodegradable film material.

3. An airdrop type buoy apparatus according to claim 1, wherein said balloon is provided with auxiliary inlet ports, on side face portions thereof, at a middle portion in a lengthwise direction of each side face portion, each said auxiliary inlet port being formed at a position that is to be scuttled when the expanded balloon lands on the water.

4. An airdrop type buoy apparatus according to claim 1, wherein one or more fine holes are formed on an upper face portion of said balloon so that said balloon expanded decreases a buoyant force thereof to be scuttled after a predetermined period of time.

5. An airdrop type buoy apparatus according to claim 1, wherein said buoyant recognition member functions as a hydrographic conditions measuring member measuring hydrographic conditions of a predetermined point on the water.

6. An airdrop type buoy apparatus, which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

a suspension rope connected to said annular member of the balloon at one end portion thereof so as to extend by a predetermined length, said suspension rope having flexibility;

a plumb bob connected to the other end portion of said suspension rope to serve as a plummet at the time of falling and landing of said balloon;

a buoyant recognition member disposed on an upper surface portion of said balloon, for being floated on the water to act as a marker indicating a predetermined point on said water after the expanded balloon lands on the water; and a container housing therein a combination of said balloon, suspension rope and plumb bob, and accessories thereof, to be delivered for dropping.

7. An airdrop type buoy apparatus according to claim 6, wherein said balloon is formed in a bag shape using a biodegradable film material.

8. An airdrop type buoy apparatus according to claim 6, wherein said balloon is provided with auxiliary inlet ports, on side face portions thereof, at a middle portion in a lengthwise direction of each side face portion, each said auxiliary inlet port being formed at a position that is to be scuttled when the expanded balloon lands on the water.

9. An airdrop type buoy apparatus according to claim 6, wherein one or more fine holes are formed on an upper face portion of said balloon so that said balloon expanded decreases a buoyant force thereof to be scuttled after a predetermined period of time.

10. An airdrop type buoy apparatus according to claim 6, wherein said buoyant recognition member functions as a hydrographic conditions measuring member measuring hydrographic conditions of a predetermined point on the water.

11. An airdrop type buoy apparatus which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

a suspension rope connected to said annular member of the balloon at one end portion thereof so as to extend by a predetermined length, said suspension rope having flexibility;

a plumb bob connected to the other end portion of said suspension rope to serve as a plummet at the time of falling and landing of said balloon; and a buoyant recognition member disposed on an upper surface portion of said balloon, for being floated on the water to act as a marker indicating a predetermined point on said water after the expanded balloon lands on the water; and a function member on the upper surface portion of said balloon in a state where three or more securing cables each of which is connected at one end portion thereof to said annular member on the lower side of said balloon are tied at the other end portions thereof to said function member so that said function member is floated on the water to achieve a predetermined function after the expanded balloon lands on the water.

12. An airdrop type buoy apparatus according to claim 11, wherein said three or more securing cable are connected to each other via guide cables, which are wound on the outer periphery of said balloon within a range of the height in a lengthwise direction of said balloon.

13. An airdrop type buoy apparatus which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

a suspension rope connected to said annular member of the balloon at one end portion thereof so as to extend by a predetermined length, said suspension rope having flexibility;

a plumb bob connected to the other end portion of said suspension rope to serve as a plummet at the time of falling and landing of said balloon; and a parachute added to said plumb bob for absorbing a shock due to the stretch of said suspension rope when said balloon falls.

14. An airdrop type buoy apparatus which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

suspension rope connected to said annular member of the balloon at one end portion thereof so as to extend by a predetermined length, said suspension rope having flexibility;

a plumb bob connected to the other end portion of said suspension rope to serve as a plummet at the time of falling and landing of said balloon;

function member disposed on the upper surface portion of said balloon in a state where three or more securing cables each of which is connected at one end portion thereof to said annular member on the lower side of said balloon are tied to said function member at the other end portions thereof, so that said function member is floated on the water to achieve a predetermined function after the expanded balloon lands on the water; and a container housing therein a combination of said balloon, suspension rope and plumb bob, and accessories thereof, to be delivered for dropping.

15. An airdrop type buoy apparatus according to claim 14, wherein said three or more securing cables are connected to each other via guide cables, which are wound on the outer periphery of said balloon within a range of the height in a lengthwise direction of said balloon.

16. An airdrop type buoy apparatus which is dropped by a flight vehicle flying in the air, and during falling, decreases a falling speed thereof to a predetermined speed while expanding, and then lands on the water to be floated, comprising:

a balloon provided, at a lower end opening thereof, with an annular member for introducing air into said balloon when falling, for letting air therein via said annular member so as to be expanded and to hold a three-dimensional shape after landing;

a suspension rope connected to said annular member of the balloon at one end portion thereof so as to extend by a predetermined length, said suspension rope having flexibility;

a plumb bob connected to the other end portion of said suspension rope to serve as a plummet at the time of falling and landing of said balloon;

a parachute added to said plum bob for absorbing a shock due to the stretch of said suspension rope when said balloon falls; an a container housing therein a combination of said balloon, suspension rope and plumb bob, and accessories thereof, to be delivered for dropping.

* * * * *